US006069963A

United States Patent [19]

Martin et al.

[11] Patent Number: 6,069,963

[45] Date of Patent: May 30, 2000

[54] HEARING AID WHEREIN THE DIRECTION OF INCOMING SOUND IS DETERMINED BY DIFFERENT TRANSIT TIMES TO MULTIPLE MICROPHONES IN A SOUND CHANNEL

[75] Inventors: Raimund Martin, Eggolsheim; Joseph Sauer, Strullendorf, both of Germany

[73] Assignee: Siemens Audiologische Technik GmbH, Erlangen, Germany

[21] Appl. No.: 08/914,341

[22] Filed: Aug. 15, 1997

[30] Foreign Application Priority Data

Aug. 30, 1996 [DE] Germany ..... 196 35 229

[51] Int. Cl.[7] ..... H04R 25/00

[52] U.S. Cl. ..... 381/313; 381/355

[58] Field of Search ..... 381/313, 322, 381/327, 324, 330, 328, 71.11, 355, 356, 357, 111, 122

[56] References Cited

U.S. PATENT DOCUMENTS 4,712,244 12/1987 Zwicker et al. .
4,751,738 6/1988 Widrow et al. .
4,773,095 9/1988 Zwicker et al. .
5,033,090 7/1991 Weinrich .
5,201,006 4/1993 Weinrich .
5,875,254 2/1999 Hanright .

FOREIGN PATENT DOCUMENTS 0 499 699B1 11/1991 European Pat. Off. .
23 37 078 2/1974 Germany .

*Primary Examiner*—Wing F. Chan
*Assistant Examiner*—Phylesha Dabney
*Attorney, Agent, or Firm*—Hill & Simpson

[57] ABSTRACT

A direction-sensitive hearing aid is provided with a housing, at least one signal processor, at least one microphone in communication with the signal processor as well as at least one sound opening. A simplified arrangement of operating elements is provided as well as effective shielding from electromagnetic disturbances with a continued, good directional effect given improved protection against contamination. The hearing aid is provided with a sound channel. The sound channel has at least two openings, and at least two microphones are positioned along the sound channel via which the sound within the sound channel can be acquired. The direction of the sound can be determined based on the differences in sound transit time within the sound channel.

20 Claims, 4 Drawing Sheets

HEARING AID WHEREIN THE DIRECTION OF INCOMING SOUND IS DETERMINED BY DIFFERENT TRANSIT TIMES TO MULTIPLE MICROPHONES IN A SOUND CHANNEL

BACKGROUND OF THE INVENTION

The present invention generally relates to direction-sensitive hearing aid with a housing, at least one signal processing means, at least one microphone in communication with the signal processing means as well as at least one sound opening.

German Patent No. DE-AS 23 37 078 discloses a direction-sensitive hearing aid with a directional microphone that is arranged in a housing and has two spatially separated sound admissions that are acoustically connected to spatially separated sound openings for the admission of the sound into the hearing aid. The directional microphone recognizes the direction of the sound signal based on the difference in running time of sound waves incident onto the sound admissions of the directional microphone. This known hearing aid, accordingly, requires the use of directional microphones.

European Patent No. EP 0 499 699 B1 discloses a hearing aid device with two microphones wherein each microphone has its own sound admission opening allocated to it, and the direction of a sound wave can be identified by determining the difference in running time of the entering sound waves. Given this hearing aid device, the sound admission openings are arranged at the upper side. As a result, these openings easily get dirty and also limit the possibilities with respect to design and operating ease due to their positioning. In addition, this hearing aid device is difficult to shield against electromagnetic noise fields, for example, to radiotelephones, as a result of the sound admission openings to be arranged in the operating region.

SUMMARY OF THE INVENTION

The present invention relates to a direction-sensitive hearing aid with good directional effect available that offers improved protection against contamination of the sound admission openings, assures comprehensive possibilities for the arrangement of operating devices and enables good shielding from electromagnetic noise fields.

To this end, in an embodiment of the present invention, a direction-sensitive hearing aid is provided with a housing, at least one signal processing means, at least one microphone in communication with the signal processing means as well as at least one sound opening. The hearing aid has a sound channel wherein the sound channel has at least two openings and at least two microphones positioned along the sound channel such that the sound within the sound channel is acquired with the at least one microphone and the direction of the sound is identifiable with the at least one microphone based on differences in sound transit time within the sound channel.

In an embodiment, the microphones are positioned at a fixed spacing from one another.

In an embodiment, a total of two openings is provided.

In an embodiment, two microphones are provided and each microphone is allocated to an opening of the sound channel.

In an embodiment, more than two microphones are provided wherein one microphone serves as a base microphone that can be optionally interconnected in pairs with a further microphone.

In an embodiment, a plurality of microphone pairs are provided and each microphone pair is allocated to a specific frequency range. The allocation of the microphones to microphone pairs may be variable.

In an embodiment, a separate amplifier is allocated to each of the individual microphones.

In an embodiment, an opening of the sound channel is provided at each of a front side and a back side of the sound channel, particularly at the respective end face thereof.

In an embodiment, the position of the openings at the housing is variable.

In an embodiment, the openings are provided with a protective covering. The protective covering may be water repellant.

In an embodiment, the sound channel is provided with a radiation-shielding material. The radiation-shielding material may be located at an inside wall of the sound channel. The radiation-shielding material may be a metal layer.

In an embodiment, the sound channel is an integral component part of the housing.

In an embodiment, the sound channel is a component part of a temple piece of eyeglasses.

In an embodiment, the sound channel is constructed from a flexible material.

In an embodiment, the microphones are silicon microphones. The silicon microphones may have an integrated analog-to-digital converter.

The hearing aid of the present invention has a sound channel that encompasses at least two sound openings. Further, at least two microphones through which the sound can be acquired within the sound channel are positioned within the sound channel. The goal of this arrangement is to realize a gradient receiver from which a sound signal is acquired at least two different locations, i.e. after different signal transit times within a sound channel. The signal running times arise in that a sound signal enters through the respective opening into the sound channel temporally different and, accordingly, is acquired by microphones after different times.

Due to the use of one sound channel, an advantage of the present invention is that a good shielding of the component parts located in the inside of the sound channel can be achieved since the sound admission openings can be arranged in the end region of the sound channel where they do not represent a disadvantage in view of the shieldability.

Further, an advantage of the present invention is that it provides a beneficial arrangement of operating elements and, thus, eases operation of the hearing aid.

Moreover, another advantage of the present invention is that fewer feedbacks occur since the microphone opening is not located in the region of the operating surface.

To correctly identify the direction of the sound that is acquired by the microphones at different times via the sound channel, the present invention positions the microphones at a fixed distance from one another. The frequency range that is located can be determined by the selection of the spacing.

In an embodiment of the present invention, two openings are provided wherein a microphone is allocated to each opening of the sound channel.

In another embodiment of the present invention, a hearing aid with more than two microphones is provided wherein the microphones can be interconnected in pairs.

In yet another embodiment of the present invention, one microphone can be provided as a base for a microphone.

Microphone pairs allocated to one another may also be formed wherein the allocation can be fixed or variable. A specific frequency range can be defined by selecting the allocation of two microphones to a pair. For example, two outer microphones within the sound channel may cover the bass frequency range. By contrast, a high frequency range may be covered by switching the allocation of, for example, an outer microphone to a middle microphone.

Upon employment of one microphone as the base microphone, the plurality of microphones can be kept low since only the locating of the sound or the acquisition of the reference signals ensues via the microphone serving as the base microphone. This embodiment is advantageous particularly in view of the demands for small dimensions.

It, therefore, becomes possible to vary the directional characteristic by variable interconnection of microphones to form microphone pairs.

According to another embodiment of the present invention, the individual microphones each respectively have their own amplifier allocated to them. As a result, the amplification signals can be respectively processed with reference to a frequency range.

When the openings are provided at the front and back side of the sound channel, particularly in the end face region thereof, the operating elements can, on the one hand, be placed easily accessible at the upper side of the sound channel; second, feedback effects due, for example, to the hand of the wearer when making a setting are avoided as a result of this arrangement. Moreover, dandruff, dust or the like cannot proceed directly into the sound channel or degrade the function of the microphones. Over and above this, the microphones do not get dirty as quickly since they are located at the inside of the sound channel. Further, the entire upper side is available for the application of operating elements, as a result whereof the employment of larger operating elements, i.e. particularly operating elements that are easier to grip, becomes possible and an ergonomically more beneficial arrangement thereof becomes available.

By varying the position of the opening at the device, an adaptation to specific auditory situations can be achieved in that a variation of the frequency range that can be covered with the hearing aid occurs by varying the position of the openings at the device.

To avoid contamination of the microphones and/or of the sound channel, the openings are expediently provided with a protective covering that, for example, can be composed of synthetic fibers and prevents the penetration of moisture and dirt into the sound channel.

To avoid disadvantageous degradation due to noise fields caused by radiotelephones, for example, the sound channel is expediently provided with a radiation-shielding material, particularly a metallization. As a result of the fashioning of the sound channel of the present invention, the shielding can be nearly completely provided over its principal surfaces, an effective radiation shielding being achieved as a result thereof. In a specific embodiment of the present invention, the shielding is located at the inside of the sound channel and is, therefore, protected against mechanical influences.

For an especially miniaturized embodiment of the hearing aid, the sound channel is provided as an integral component part of the housing. Further, the sound channel can also be provided as a component part of a temple piece of eyeglasses.

A further embodiment of the invention provides that the sound channel is flexible. The frequency range to be covered can be expediently varied by changing the geometry of the sound channel.

A further advantage of the present invention is that silicon microphones can be utilized. These and the integration of further circuit parts on the same chip from which the microphone was realized allow a high degree of miniaturization.

Over and above this, silicon microphones have a low power consumption and reduced noise sensitivity, particularly with respect to electromagnetic fields. Insofar as silicon microphones have been fabricated from an identical wafer, their signal pick-up properties are nearly identical, which may be of considerable use for the determination of the differences in signal running time upon employment of a plurality of microphones within the sound signal.

Within the scope of the present invention, silicon microphones with an integrated analog-to-digital converter can be utilized so that the analog-to-digital converter is also located within the sound channel. As a result thereof, possible electromagnetic disturbances to which conventional microphones with external analog-to-digital converters are susceptible may be minimized further.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
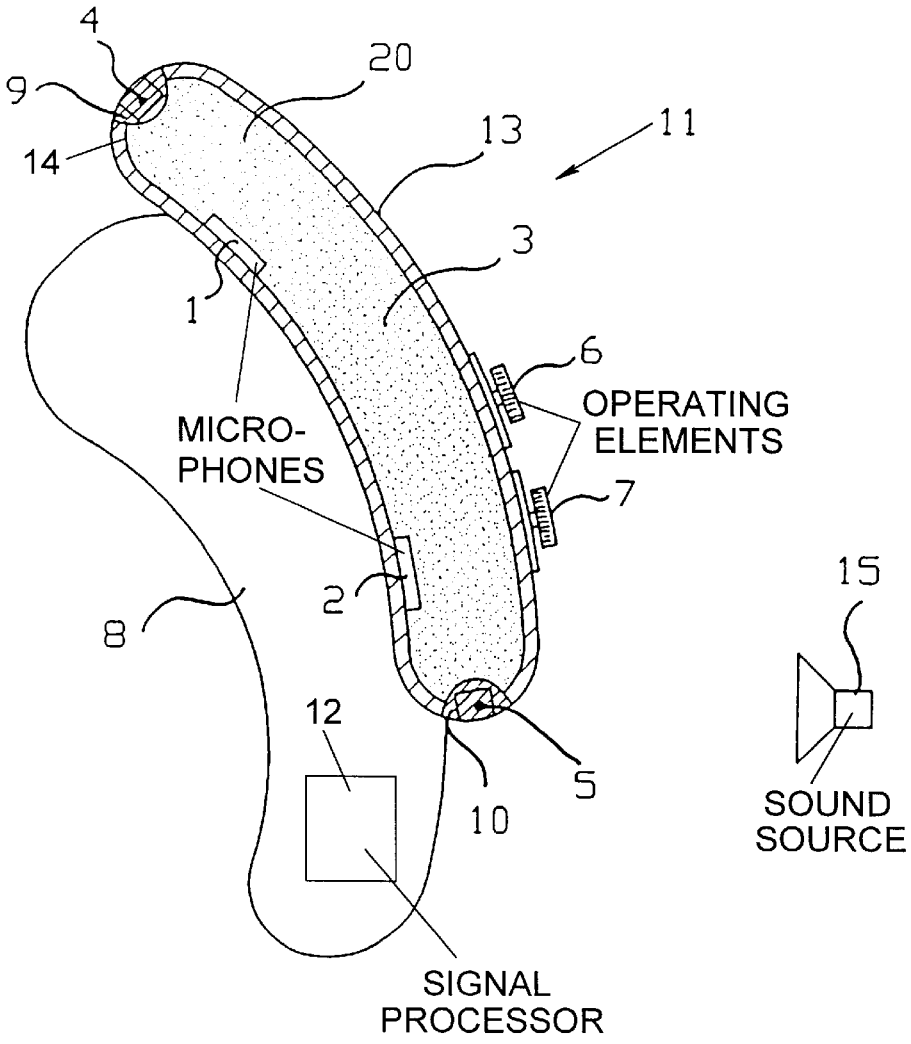
FIG. 1 illustrates a partial sectional view of an embodiment of a hearing aid of the present invention with two microphones.

Referring now to the drawings, a hearing aid of the present invention is generally designated at 11. The hearing aid 11 has an oblong, hose-like sound channel 3 at an upper side of a housing 8. Two microphones 1, 2 are arranged in an inside of the sound channel 3 at a fixed, predetermined distance from one another. The housing 8 is shown schematically in FIG. 1, as well as the sound channel 3 put in place onto the housing 8.

The sound channel 3 is shaped with a slight curve and has openings 4, 5 at its front side and its back side. The openings 4, 5 are respectively located in an end face region of the sound channel 3.

Operating elements 6,7 for varying certain parameters such as, for example, gain or sensitivity are provided in the outer region of the sound channel 3. The components (not shown) required for signal processing (collectively forming a signal processor 12), such as, for example, amplification elements, filters and the like, are located in the lower region of the housing.

To avoid penetration of dirt, the two end-face openings 4, 5 of the sound channel 3 are provided with respective protective coverings 9 and 10 as shown by the shaded region in FIG. 1.

Further, as indicated by the dotted region in FIG. 1, an inside wall 14 of the sound channel 3 is provided with radiation-shielding material 10, for example a metallization 20. Advantageously, the radiation-shielding effect is not limited to the sound channel 3 itself but also extends onto the components of the hearing aid 11 located in the housing 8 as a result of the geometrical arrangement of the sound channel 3 in an upper region of the housing 8.

The microphones 1 and 2 may be expediently fashioned as "silicon microphones". The silicon microphones may also be combined with an analog-to-digital converter.

Sound signals originating from a sound source 15 impinge the hearing aid 11 and proceed via the openings 4, 5 into the sound channel 3. Due to the different spacing of the microphones 1, 2 from the openings 4, 5, the sound that enters, for example, through the opening 5, is picked up first by the microphone 2 and then by the microphone 1. The difference between the respective acquisition of the sound signal, which is referred to as signal transit time, opens up the possibility of preferring sound signals from a specific direction.

In the signal processor 12 the acquired sound signal is edited such that an allocation of the signal to a specific direction is possible.

Figure 2:
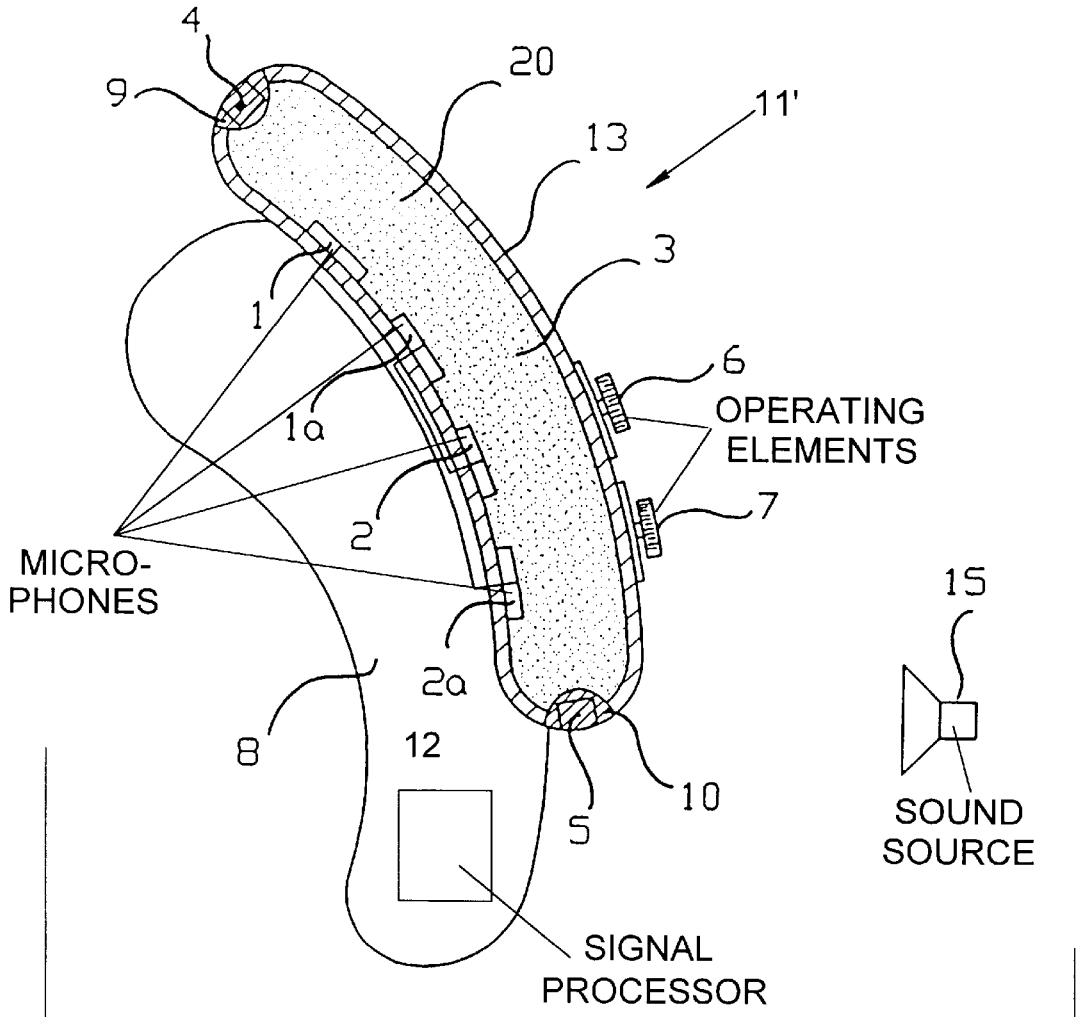
FIG. 2 illustrates a partial sectional view of another embodiment of the present invention using a total of four microphones.

The embodiment of a hearing aid 11' is shown in FIG. 2 wherein a plurality of microphones 1, 1*a*, 2, 2*a* are arranged at specific intervals relative to one another along the sound channel 3. The microphones 1, 1*a*, 2, 2*a* are connected in pairs for acquiring the sound direction. In FIG. 2, thus, the microphones 1 and 2*a* arranged at the outside are interconnected as indicated by the connecting lines to cover the bass, or low, frequency range. By contrast, the microphones 1*a*, 2 arranged in the middle are wired as a microphone pair to cover the high, or treble frequency range.

A specific frequency range can be covered with the hearing aid by selecting specific microphone pairs and/or by the positioning of the microphones relative to one another. Microphone pairs that are respectively fixed relative to one another can thereby be provided. However, the possibility exists of respectively connecting microphones variable in their paired allocation specific to use.

The microphones 1, 1*a*, 2, 2*a* are provided with their own amplifiers (not shown) allocated to the respective microphone so that the amplification signals can be processed respectively related to frequency range.

Figure 3:
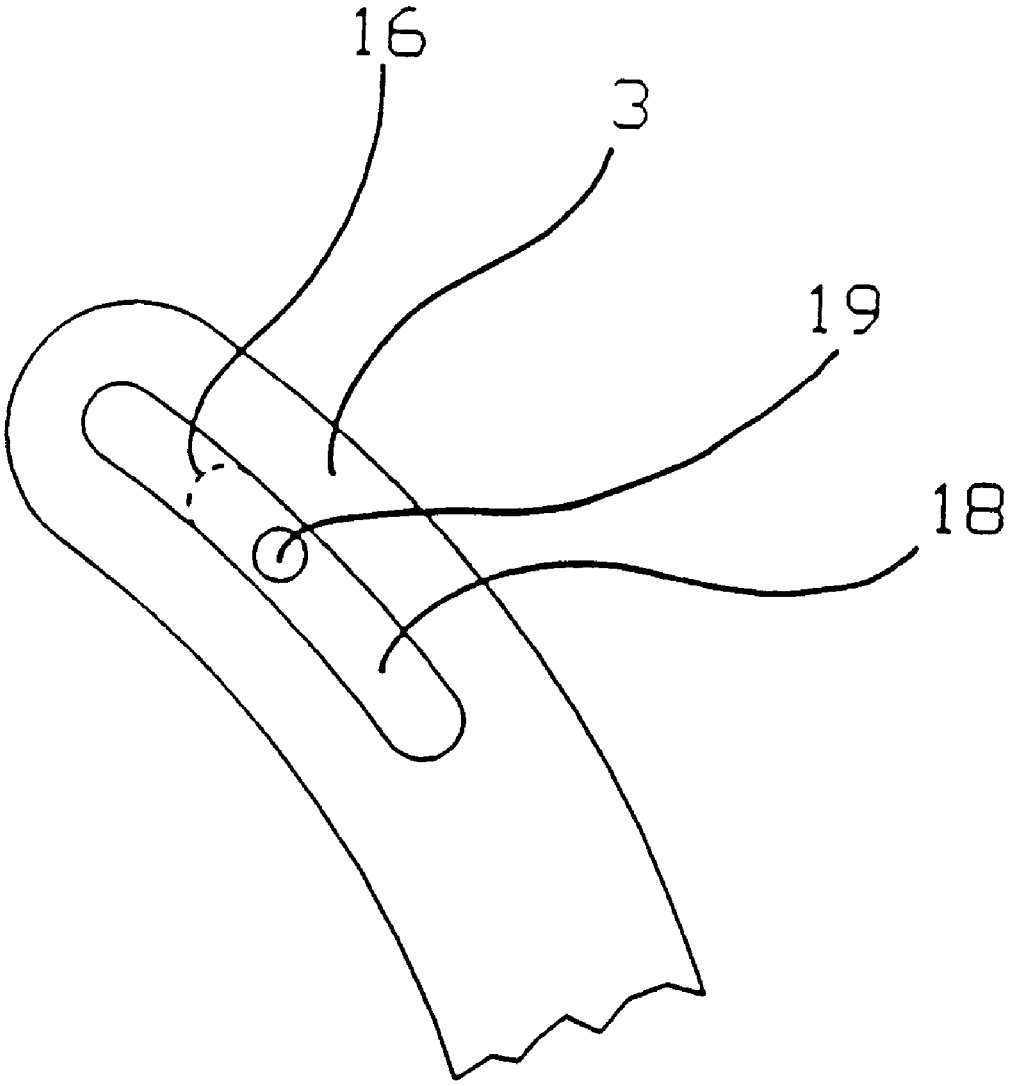
FIG. 3 illustrates an end sectional view of an embodiment of the sound channel with variable-position opening.

FIG. 3 shows a specific embodiment of the hearing aid wherein the position of an opening 19 is variable along the sound channel 3. In the specific embodiment of FIG. 3, an oblong hole 16 is provided over which a slide 18 with the opening 19 is attached. By displacing the slide 18 along the oblong hole 16, the opening 19 moves into a predetermined region. As a result, the position of the opening 19 varies.

Figure 4:
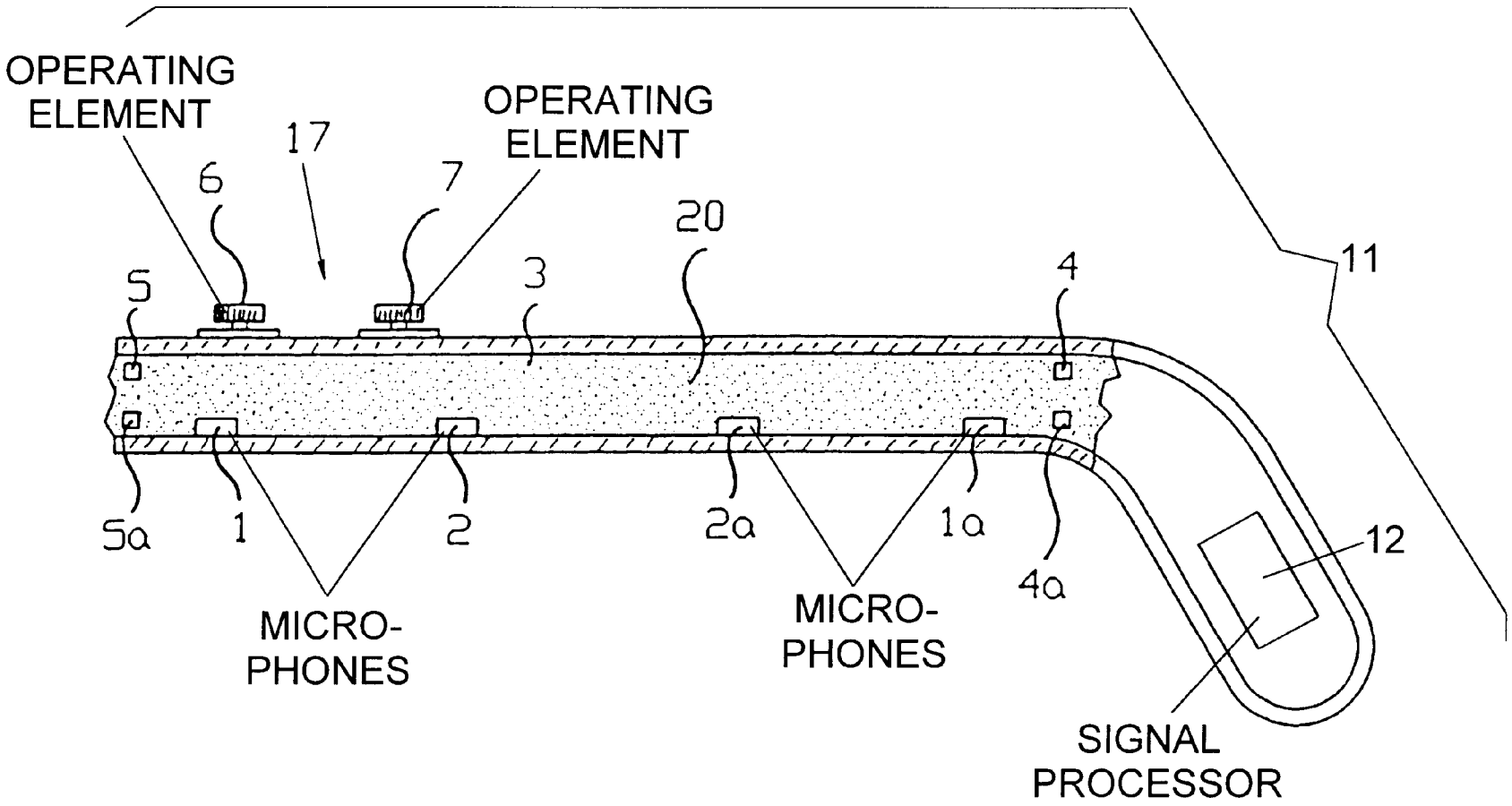
FIG. 4 illustrates a partial sectional view of an embodiment of the present invention wherein the sound channel is integrated in a temple piece of eyeglasses.

FIG. 4 shows another embodiment of the invention wherein the sound channel 3 is fashioned as a component of a temple piece 17 of eyeglasses with the sound channel 3 integrated in the temple piece 17 of the eyeglasses. The sound channel 3 has a total of four microphones 1, 1*a*, 2, 2*a*.

The openings in the respective sound channel 3 are identified with reference characters 4, 4*a*, 5, 5*a*. As in the embodiments described above, the sound channel 3 here also has its inside provided with radiation-absorbing material, particularly the metallization 20. The operating elements 6, 7 can be located at an upper side of the temple piece 17 of the eyeglasses.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A direction-sensitive hearing aid comprising:

a housing;

an enclosed sound channel connected to said housing having at least two sound admission openings therein for admitting sound into said sound channel originating from outside of said sound channel;

at least two microphones disposed in said sound channel to receive said sound, said at least two microphones being disposed at respectively different distances from said at least two sound admission openings so that said sound exhibits respectively different transit times to said at least two microphones; and a signal processor connected to said at least two microphones for identifying, dependent on said respectively different transit times, a direction from which said sound originates outside of said sound channel.

2. The hearing aid according to claim 1 wherein the microphones are positioned at a fixed spacing from one another.

3. The hearing aid according to claim 1 comprising a total of two of said sound admission openings.

4. The hearing aid according to claim 1 comprising a total of two microphones respectively allocated to said two sound admission openings.

5. The hearing aid according to claim 1 wherein more than two microphones are provided wherein one microphone serves as a base microphone that can be optionally interconnected in pairs with a further microphone.

6. The hearing aid according to claim 1 wherein said more than two microphones are connected to said signal processor to form a plurality of microphone pairs, with each microphone pair being allocated to a specific frequency range.

7. The hearing aid according to claim 6 comprising means for altering the connections of said more than two microphones to said signal processor to selectively allocate individual ones of the more than two microphones to the respective microphone pairs.

8. The hearing aid according to claim 1 wherein a separate amplifier is allocated to each of the individual microphones.

9. The hearing aid according to claim 1 wherein said sound channel has a front side and a back side and wherein said at least two sound admission openings include sound admission openings respectively disposed at said front side and said back side of the sound channel.

10. The hearing aid according to claim 1 wherein said sound admission openings are respectively disposed at different positions at said housing, and comprising means for altering the respective positions of said sound admission openings at the housing.

11. The hearing aid according to claim 1 wherein the sound admission openings are each provided with a protective covering.

12. The hearing aid according to claim 11 wherein each protective covering is water repellant.

13. The hearing aid according to claim 1 wherein the sound channel is provided with a radiation-shielding material.

14. The hearing aid according to claim 13 wherein the radiation-shielding material is located at an inside wall of the sound channel.

15. The hearing aid according to claim 13 wherein the radiation-shielding material is a metal layer.

16. The hearing aid according to claim 1 wherein the sound channel is an integral component of the housing.

17. The hearing aid according to claim 1 wherein said housing comprises a part of eyeglasses and wherein the sound channel is a component of a temple piece of said eyeglasses.

18. The hearing aid according to claim 1 wherein the sound channel is constructed of a flexible material.

19. The hearing aid according to claim 1 wherein the microphones are silicon microphones.

20. The hearing aid according to claim 19 wherein each of the silicon microphones has an integrated analog-to-digital converter.

* * * * *